US005314086A

United States Patent [19]

Short

[11] Patent Number: 5,314,086

[45] Date of Patent: May 24, 1994

[54] THERMAL REFLECTING INSULATABLE PAD

[76] Inventor: Robert Short, 105, 242 East 14th Street, Vancouver, B.C., Canada, V5T 2M6

[21] Appl. No.: 29,555

[22] Filed: Mar. 11, 1993

Related U.S. Application Data

[63] Continuation-in-part of Ser. No. 729,985, Jul. 15, 1991, abandoned.

[51] Int. Cl.[5] ..... B65D 25/08; B65D 27/08

[52] U.S. Cl. ..... 220/400; 206/438; 206/522; 383/3; 383/38

[58] Field of Search ..... 220/400; 206/219, 438, 206/522, 803; 383/3, 38

[56] References Cited

U.S. PATENT DOCUMENTS

| | | | |
|---|---|---|---|
| 3,332,415 | 7/1967 | Ericson | 383/3 |
| 3,742,994 | 7/1973 | Pensak | 383/3 |
| 3,818,962 | 6/1974 | Muller-Scherak | 383/3 |
| 4,240,556 | 12/1980 | Field | 206/522 |
| 4,465,188 | 8/1984 | Soroka et al. | 206/522 |
| 4,550,833 | 11/1985 | Hoheisel | 383/3 |
| 4,632,244 | 12/1986 | Landau | 206/219 |
| 4,705,085 | 11/1987 | Brown | 383/3 |
| 4,941,754 | 7/1990 | Murdock | 383/3 |

*Primary Examiner*—Joseph Man-Fu Moy

[57] ABSTRACT

A flexible, thermal, reflective insulating pad which includes a first outer wall of flexible, transparent, air-impermeable material, a second outer wall of flexible, transparent, air-impermeable material sealed or fused to the first outer wall around the perimeter thereof to form a pneumatically secure chamber. A specularly, infra-red reflective layer is located in the chamber. Means are provided for introducing air into the chamber. The first and second outer walls are fused together along parallel spaced apart lines along a length of the pad so as to form compartments in fluid communication with each other around the ends thereof. Releasable connectors located at the ends of the pad releasably connect to each other. Upon being deflated the pad can be rolled up so as to occupy a relatively small volume.

8 Claims, 8 Drawing Sheets

THERMAL REFLECTING INSULATABLE PAD

RELATED APPLICATIONS

The present application is a continuation-in-part of Application Ser. No. 07/729,985, filed Jul. 15, 1991, now abandoned.

FIELD OF THE INVENTION

The present invention relates to a thermal reflecting insulatable pad which may be used for a variety of purposes such as an insulating pillow, cushion or beverage insulator.

BACKGROUND OF THE INVENTION

The present invention relates to a flexible, thermal insulative, infra-red reflective pad which can be used to insulate a beverage container or for other purposes.

Previously, the insulation of beverages from hostile environments has been accomplished by a number of means, such as insulating bottles or jugs. However, these means did not allow for the insulation of pre-packaged beverage containers and were bulky to transport and, in some cases, fragile. The use of coolers to store pre-packaged beverage containers is made difficult by their size, and does not address the problem of insulating an individual beverage container once removed from the cooler to be consumed.

Recent products designed to insulate a single beverage container have consisted of styrofoam jackets surrounding the container on its sides and bottom. While these may provide insulation from the environment, their rigidity limits their use to the insulation of beverage containers of the size for which they were formed. The size of such insulators cannot be adjusted. Furthermore, these insulators are easily damaged and their bulk becomes inconvenient when large numbers are transported.

U. S. Pat. No. 4,705,085 issued to Brown on Nov. 10, 1987 discloses an inflatable beverage insulator for insulating a beverage container. The insulator has a jacket portion and an integral base to provide a cavity for the container. Once inflated the insulator provides thermal insulation to the beverage container. The jacket is formed with a plurality of parallel fused lines which form cells or compartments that are in fluid communication with each other around their ends. Integral with the jacket is a bottom that is in fluid communication with the jacket. An air valve coupled to the bottom also directs air to and from the jacket. The jacket is folded on itself and welded. The bottom is then welded around the perimeter of the bottom of the jacket to form a permanent cup-shaped structure. Although Brown is deflatable its permanent cup-shape and bottom prevents it from being rolled up into a small enough package so that it can be stored conveniently in a pocket or purse of a user.

SUMMARY OF THE INVENTION

The present invention comprises a thermally reflective, insulating, inflatable pad which may be used for a variety of purposes. The thermal reflective properties of the device allow the minimization of heat transfer between a system insulated by the pad and the exterior environment. Some of the purposes making use of this pad include use as an insulator for beverage containers, thereby allowing the retention of beverage temperature, or use as a thermal reflecting pillow, for the retention of body heat.

In its preferred embodiment, the pad is flexible, thermal reflective and insulative and is comprised a first outer wall of flexible, transparent, air-impermeable material, a second outer wall of flexible, transparent, air-impermeable material sealed or fused to the first outer wall around the perimeter thereof to form a pneumatically secure chamber. A specularly, infra-red reflective layer is located in the chamber. Means are provided for introducing air into said chamber. The first and second outer walls are fused together along parallel spaced apart lines along a length of the pad so as to form compartments in fluid communication with each other around the ends thereof. Means for releasably connecting ends of the pad to each other are provided. Upon being deflated the pad can be rolled up so as to occupy a relatively small volume.

The connecting means is composed of releasable, interconnective strips mounted on either end of the pad such that said pad can be formed into a generally cylindrical shape after being inflated.

Another feature of the pad is that when interconnected its interior size decreases as the pad is inflated.

The pad may include an inner wall of flexible, transparent, air-impermeable material fused to both the first and second outer walls around the perimeter thereof so as to form an air chamber between the first outer wall and the inner wall and a sheet chamber between the inner wall and the second outer wall. The specularly infra-red reflective layer of material may be positioned in the sheet chamber.

A design may be formed on the inner wall facing the first outer wall.

By dividing the chamber into compartments by sealing or fusing the layers forming its walls at spaced apart intervals so as to allow fluid communication between compartments additional stability and increased flexibility is given to the pad structure. Additionally, a means for connecting a series of pads at their ends, or the ends of one pad to each other, enables the pad to wrap around an object for insulating purposes.

The flexible nature of the material allows compact storage in the deflated or empty condition, as well as size adjustment when in use. The pad therefore avoids the rigidity of size and the bulky storage requirements associated with rigid styrofoam insulators.

When filled with air, the pad may be used as a beverage insulator, a pillow, or as a flotation toy. By simply using a larger valve, the chamber may be filled with hot or cold water to perform its insulating role, or may be frozen after filling for additional cooling potential. A frozen pad may also be applied to injuries requiring ice packs, such as a sprained ankle or the like. Furthermore, filling the chamber with a dense substance such as water allows the pads to be used as wrist or ankle weights while exercising. The connectivity of the pads further permits the expansion of these uses in multiples of pads.

BRIEF DESCRIPTION OF THE DRAWINGS

The invention may be best understood by reference to the detailed description which follows, in conjunction with the accompanying drawings, where.

DETAILED DESCRIPTION WITH REFERENCE TO THE DRAWINGS

In the following described embodiments like reference numbers refer to like parts.

Figure 1:
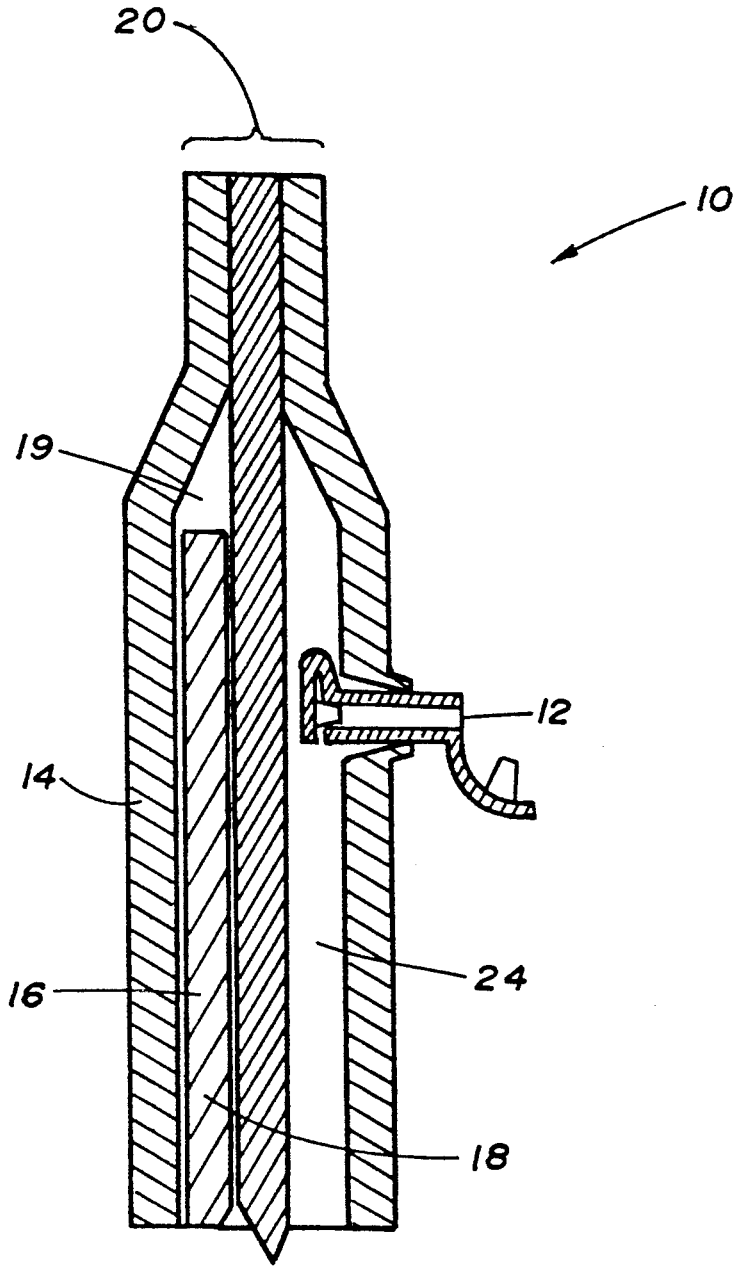
FIG. 1 is a cross-section of the pad showing perimeter seal of a structure consisting of three walls and an inserted thermal reflecting layer.

FIG. 1 illustrates the composition of the reflecting pad 10, which consists of two outer walls 12 and 14 and an inner wall 18 of flexible, air impermeable, transparent material welded or fused around its perimeter 20 to form a pneumatically secure air chamber 24 and an insert chamber 19. The material may be vinyl or any other suitable plastic. A specularly reflecting layer or sheet 16 is located in the insert chamber 19 but is not welded to perimeter 20. An air check valve 22 is installed in wall 12 to allow inflation and deflation of chamber 24.

Figure 2:
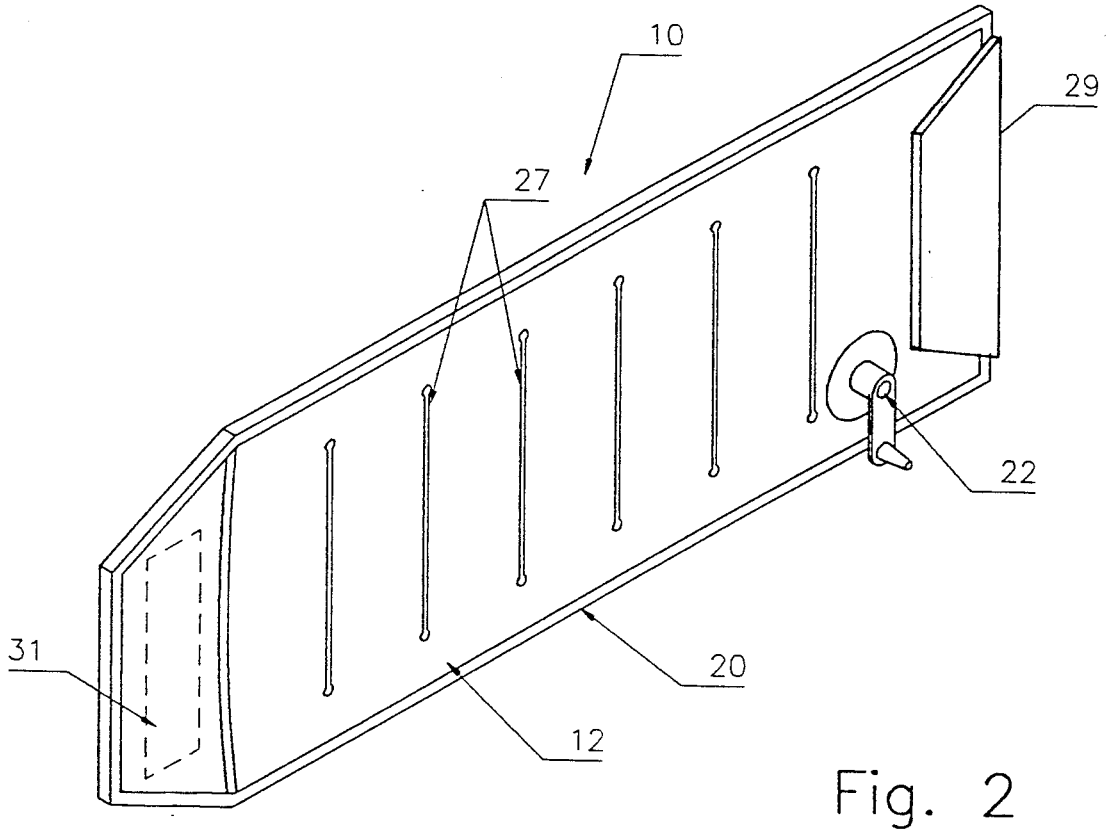
FIG. 2 is a perspective view of the pad made in accordance with FIG. 1.
Figure 3:
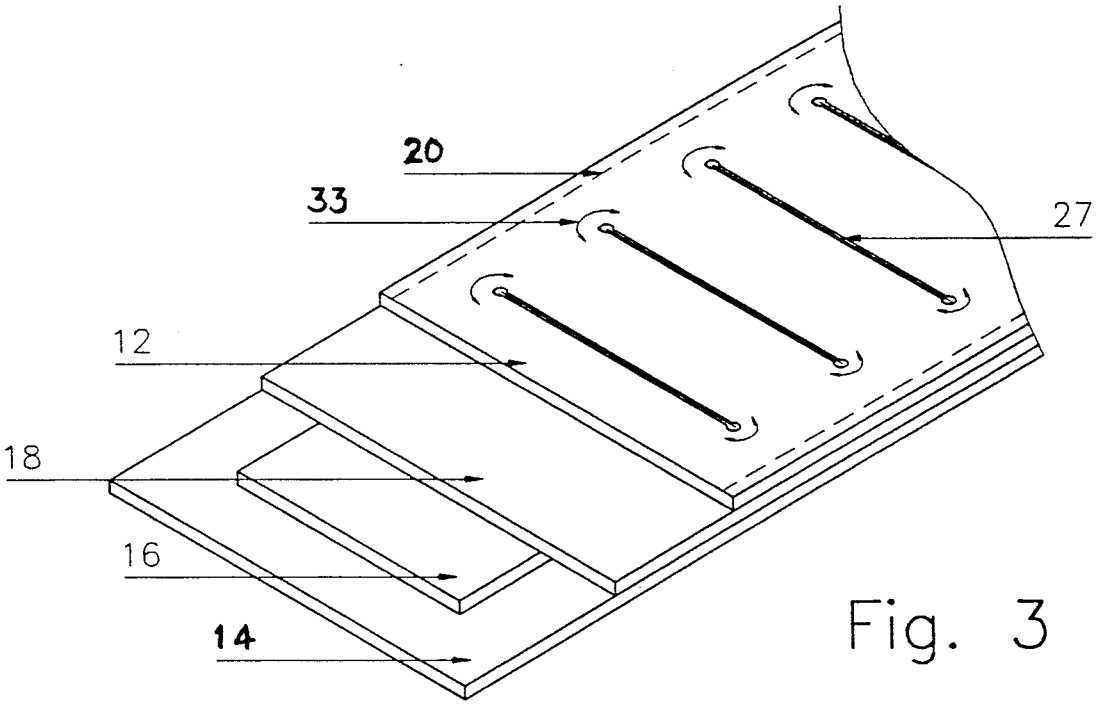
FIG. 3 is a perspective cutaway view of a portion of the layer structure of FIG. 1.

FIG. 2 discloses a pad 10 made in accordance with the structure of FIG. 1 in which parallel spaced apart lines 27 mark the fusion or weld lines of layer 12 to layer 18 so as to divide air chamber 24 into cells or compartments . Releasably interconnective pads 29 and 31 are located at opposite ends of pad 10 on opposite sides so that they may engage and form pad into a cylindrical shape. Pads 29 and 30 may be made of Velcro (Trademark). The layer structure of the pad of FIG. 2 is shown in FIG. 3 in which weld lines 27 are shown being short of perimeter weld 20 so that air can flow from one cell to another around the ends 33.

Figure 4:
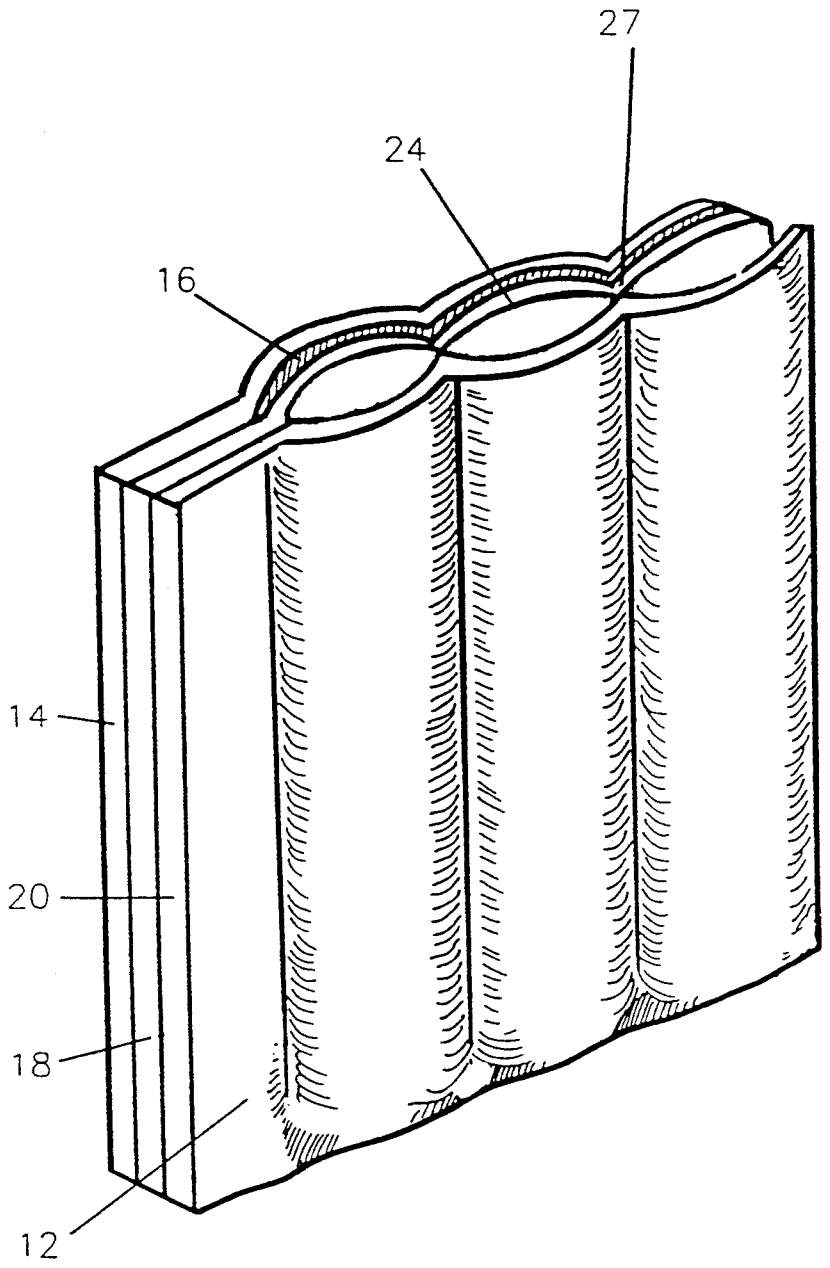
FIG. 4 is a perspective view of a portion of the pad of FIG. 1 filled with air.

FIG. 4 shows a portion of the structure of FIG. 2 in which the air chamber 24 is filled showing the compartment or cell structure. The latter stabilizes the pad and at the same time makes the pad foldable about the weld lines 27.

Figure 5:
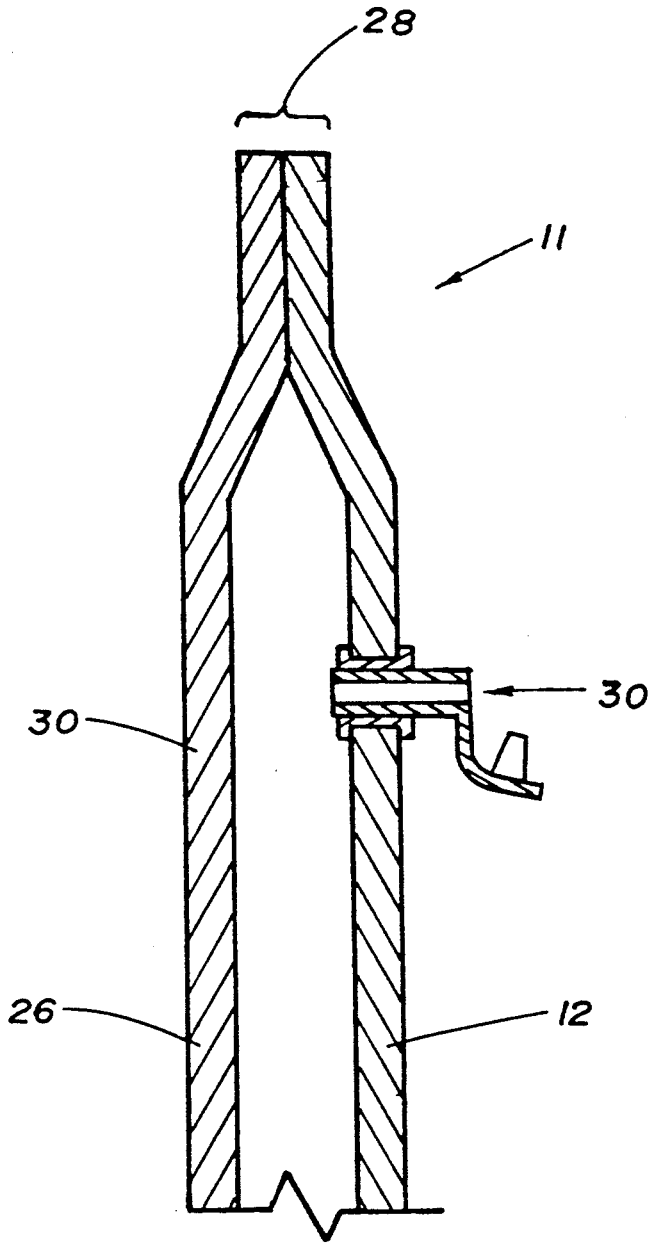
FIG. 5 is a cross-section of a pad showing the perimeter seal and a two wall structure with one wall being thermal reflecting.

FIG. 5 illustrates a two-layer composition for the thermal reflecting pad 11. Wall 12 is welded around its periphery 28 to layer 26 which is specularly reflective. A resulting air chamber 30 is formed and a valve 32 in wall 12 controls air flow into and out of chamber 30. Considering that layer 26 would ordinarily bear a metal coating to make it specularly reflective, having the latter layer exposed to the outside makes it more vulnerable to being scratched or damaged.

Figure 6:
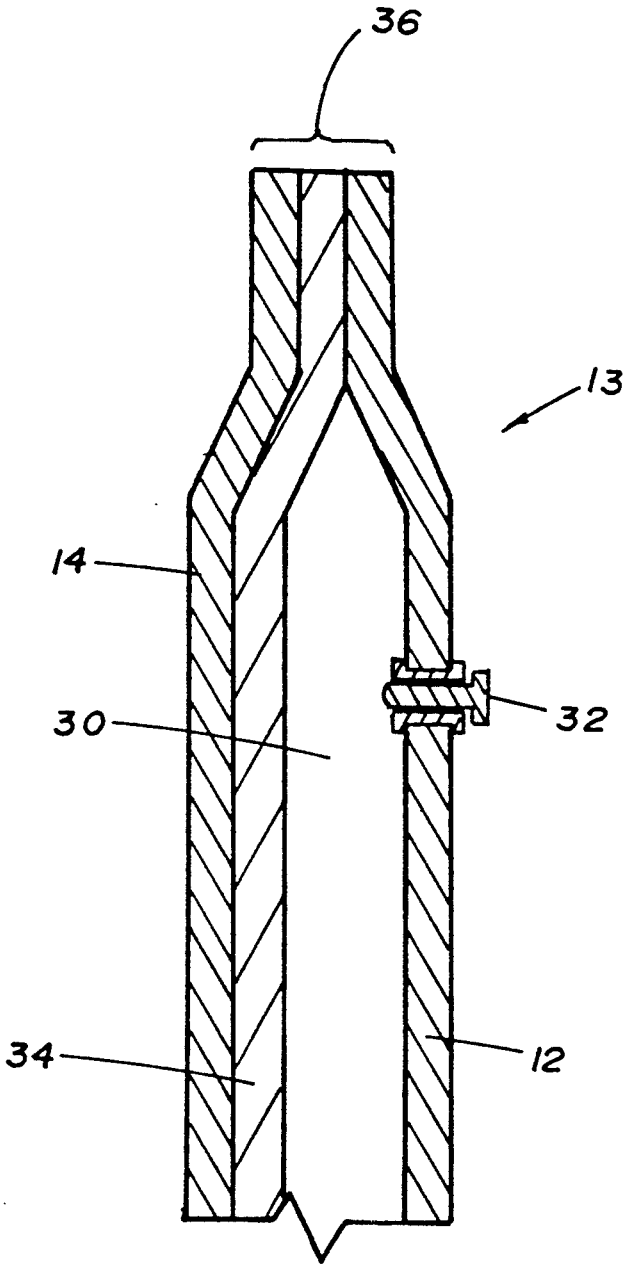
FIG. 6 is a cross-section of a three wall structure of a pad showing the perimeter seal with an inner wall being thermal reflecting.

Another alternative pad 13 is that shown in FIG. 6 in which two flexible, transparent, air-impermeable walls 14 and 12 sandwich a specularly reflective sheet 34 and are welded around a periphery 36 forming an air chamber 30. The walls 12 and 14 provide protection for the specularly reflective layer 34.

Figure 8:
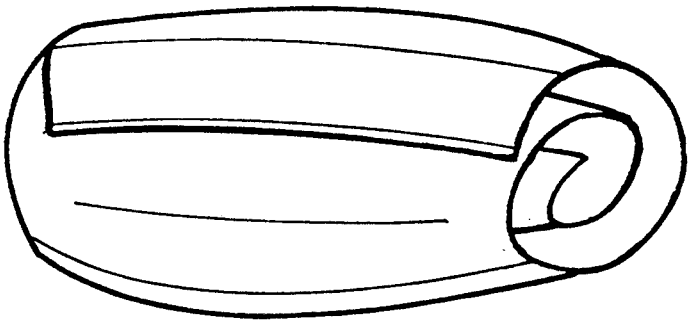
FIG. 8 is a sketch of a deflated thermal reflecting pad in a compact rolled-up form for storage.

In order to provide structural stability to the chamber 14, as well as to prevent the shifting of its contents, the two walls of material forming the chamber 19 are fused together as at regular intervals forming inner seams 27 which partition the chamber 14 into compartments. In the case of a four-wall composition, the outer wall 12 and inner wall 18 are fused to form compartments. The seams 27 allow for the passage of air from one compartment to another via channels 33, and increase the flexibility of the pad when inflated. The flexibility of the material also allows a deflated pad to be rolled into a compact form for storage (FIG. 8).

The ends of the reflective pad 10 are sufficiently large to allow connection together of a series of like pads thereby enabling the pad or pads to wrap around a larger object.

Figure 7:
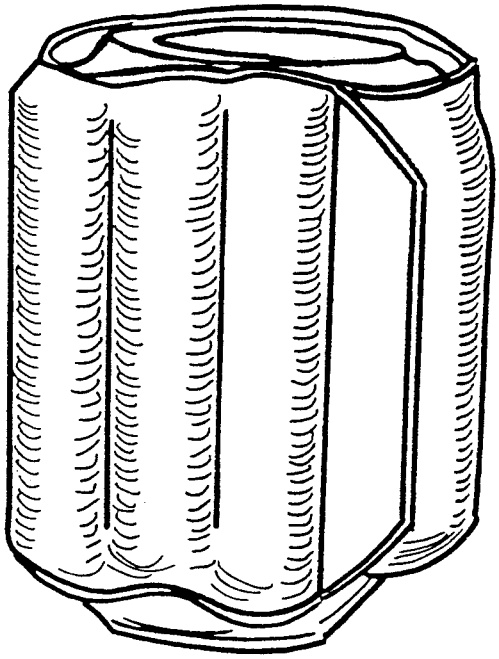
FIG. 7 is sketch of an inflated thermal reflecting pad in use as a beverage container insulator.
Figure 9:
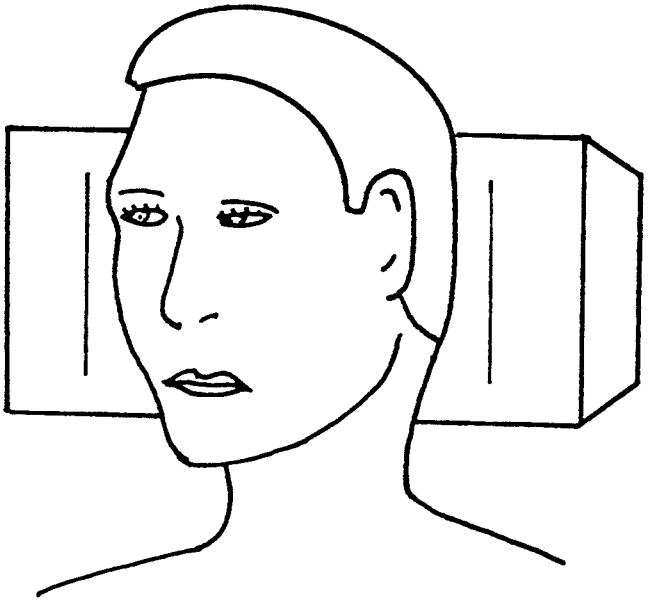
FIG. 9 is a sketch of an inflated thermal reflecting pad in use as a pillow.

The thermal reflective properties of the pad allow it to minimize the transfer of heat or cold between two systems of conflicting temperatures, while the wrap around nature allows a number of different uses. When filled with air, the pad may be wrapped around beverage containers (FIG. 7), insulating them from the hot or cold external environment or provide an thermal reflective pillow (FIG. 9), insulating the user from a hot or cold surface. Furthermore, the pad may be used a recreational flotation toy (not for safety purposes) when attached to arms or legs.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A flexible, thermal, reflective insulating pad comprising:

a) a first outer wall of flexible, transparent, air-impermeable material;

b) a second outer wall of flexible, transparent, air-impermeable material sealed or fused to said first outer wall around the perimeter thereof to form a pneumatically secure chamber;

c) a specularly, infra-red reflective layer in said chamber;

d) means for introducing air into said chamber;

e) said first and second outer walls fused together along parallel spaced apart lines along a length of said pad so as to form compartments in fluid communication with each other around the ends thereof; and f) means for releasably connecting ends of said pad to each other;

wherein upon being deflated said pad can be rolled up so as to occupy a relatively small volume.

2. A pad according to claim 1, wherein said connecting means is composed of releasable, interconnective strips mounted on either end of said pad such that said pad can be formed into a generally cylindrical shape after being inflated.

3. A pad according to claim 2, wherein the interior size of said interconnected pad decreases as said pad is inflated.

4. A flexible, thermal, reflective insulating pad comprising:

a) a first outer wall of flexible, transparent, air-impermeable material;

b) an inner wall of flexible, transparent, air-impermeable material;

c) a second outer wall of flexible, transparent, air impermeable material fused around its perimeter to said first outer wall and said inner wall so as to form an air chamber between said first outer wall and said inner wall and sheet chamber between said inner wall and said second outer wall;

d) a specularly infra-red reflective layer of material in said sheet chamber;

e) valve means for introducing air into said air chamber;

e) said first outer and inner walls fused together along parallel spaced apart lines along a length of said pad so as to form rectangular compartments in fluid communication with each other around the ends thereof; and f) means for releasably connecting ends of said pad to each other;

wherein upon being deflated said pad can be rolled up so as to occupy a relatively small volume.

5. A pad according to claim 1, including a design formed on said inner wall facing said first outer wall.

6. A pad according to claim 1, wherein said introducing means is a valve.

7. A pad according to claim 6, wherein said valve is a self-sealing one-way valve.

8. A pad according to claim 7, wherein said valve is equipped with a closure plug.

* * * * *